US010815955B2

(12) United States Patent
Dirumdam et al.

(10) Patent No.: US 10,815,955 B2
(45) Date of Patent: Oct. 27, 2020

(54) CAPACITIVE IGNITION SYSTEM

(71) Applicant: MAN Diesel & Turbo SE, Augsburg (DE)

(72) Inventors: Björn Dirumdam, Ellgau (DE); Edwin Cruz Soler, Offenburg (DE)

(73) Assignee: MAN Energy Solutions SE, Augsburg (DE)

( * ) Notice: Subject to any disclaimer, the term of this patent is extended or adjusted under 35 U.S.C. 154(b) by 769 days.

(21) Appl. No.: 13/742,407

(22) Filed: Jan. 16, 2013

(65) Prior Publication Data

US 2013/0206123 A1 Aug. 15, 2013

(30) Foreign Application Priority Data

Jan. 17, 2012 (DE) ..... 10 2012 200 633

(51) Int. Cl.
*F02P 1/08* (2006.01)
*F02P 11/02* (2006.01)
(Continued)

(52) U.S. Cl.
CPC ..... *F02P 1/08* (2013.01); *F02P 3/0846* (2013.01); *F02P 3/0876* (2013.01); *F02P 11/02* (2013.01);
(Continued)

(58) Field of Classification Search
CPC .... F02P 1/08; F02P 3/08; F02P 3/0876; F02P 7/06; F02P 7/0634; F02P 3/06–3/10; F02P 9/002; F02P 3/0846; F02P 11/02
(Continued)

(56) References Cited

U.S. PATENT DOCUMENTS 1,589,489 A * 6/1926 Snook ..... F02P 3/01 123/606
2,403,629 A * 7/1946 Berkey ..... F02C 7/266 315/177
(Continued)

FOREIGN PATENT DOCUMENTS

DE 1105240 B 4/1961
JP 57108464 A * 7/1982 ..... F02P 9/007

OTHER PUBLICATIONS

Kuphaldt, Tony R. "Lessons in Electric Circuits, vol. I—DC." Oct. 18, 2006, 5th ed., p. 444. Date accessed: Nov. 10, 2015. <http://www.allaboutcircuits.com/textbook/direct-current/chpt-13/capacitors-and-calculus/>.*
(Continued)

*Primary Examiner* — Mahmoud Gimie
*Assistant Examiner* — Joshua Campbell
(74) *Attorney, Agent, or Firm* — Cozen O'Connor

(57) ABSTRACT

A capacitive ignition system for an internal combustion engine includes a voltage converter which has two primary terminals and two secondary terminals a primary voltage source has two voltage source terminals (A+, A−) which are connected in each instance to one of the primary terminals so that a primary circuit is formed; a switch which is incorporated within the primary circuit and a controller so that the switch can be closed and opened; a first control device constructed to actuate the controller in accordance with an ignition pattern for closing and/or opening; an electrical capacitance (C1, C2) within the primary circuit; and a second control device (25) constructed to maintain constant a voltage rise at the secondary terminals, which occurs in order to reach the ignition voltage, as the ignition energy requirement of an ignition device connected to the secondary terminals changes.

4 Claims, 2 Drawing Sheets

(51) Int. Cl.

| | |
|---|---|
| ***F02P 3/08*** | (2006.01) |
| *F02P 7/063* | (2006.01) |
| *F02P 7/06* | (2006.01) |
| *F02P 9/00* | (2006.01) |

(52) U.S. Cl.
CPC . *F02P 3/08* (2013.01); *F02P 7/06* (2013.01); *F02P 7/0634* (2013.01); *F02P 9/002* (2013.01)

(58) Field of Classification Search
USPC ..... 123/596, 597, 618, 604, 605; 361/253, 361/257
See application file for complete search history.

(56) References Cited

U.S. PATENT DOCUMENTS 2,776,423 A * 1/1957 Richardson ..... G01S 13/70 342/95
2,845,547 A * 7/1958 Althouse ..... H03K 4/501 331/112
2,851,662 A * 9/1958 True ..... H03H 7/40 324/76.81
3,075,029 A * 1/1963 Michaud ..... F02P 15/12 123/624
3,241,538 A * 3/1966 Hugenholtz ..... F02P 5/155 123/406.59
3,453,492 A * 7/1969 Dotto ..... F02P 3/0884 315/209 R
3,609,486 A * 9/1971 Feldhoff ..... G05D 3/18 318/400.15
3,611,025 A 10/1971 Longauer
3,718,124 A * 2/1973 Burley ..... F02P 9/002 123/624
3,747,576 A * 7/1973 Gordon ..... F02D 41/107 123/492
3,855,984 A * 12/1974 Jacobs ..... F02P 3/0884 123/598
3,923,021 A * 12/1975 Stark ..... F02P 5/15 123/406.55
3,934,570 A * 1/1976 Asik ..... F02P 3/0884 123/598
4,441,478 A * 4/1984 Fujimoto ..... F02P 1/086 123/406.57
5,065,073 A * 11/1991 Frus ..... F02P 3/0869 123/634
5,148,084 A * 9/1992 Frus ..... F02P 3/0869 123/146.5 R
5,245,965 A 9/1993 Andersson
5,672,963 A * 9/1997 Corrigall ..... H01F 29/14 323/254
6,020,742 A * 2/2000 Kano ..... F02P 17/12 324/378
7,588,021 B2 * 9/2009 Lykowski ..... F02P 3/04 123/169 R
2003/0067284 A1 * 4/2003 Costello ..... F02P 3/0876 322/59
2003/0089353 A1 * 5/2003 Gerhardt ..... F02P 3/051 123/609
2011/0140607 A1 * 6/2011 Moore ..... A61B 18/042 315/111.21

OTHER PUBLICATIONS

Kuphaldt, Tony R. "Lessons in Electric Circuits, vol. I—DC." Oct. 18, 2006, 5th ed., p. 444. Date accessed: Nov. 10, 2015. <http://www.allaboutcircuits.com/textbook/direct-current/chpt-13/capacitors-and-calculus/>. (Year: 2006).*
Office Action dated Jul. 2, 2018 which issued in the corresponding Korean Patent Application No. 10-2012-0121138.

* cited by examiner

CAPACITIVE IGNITION SYSTEM

BACKGROUND OF THE INVENTION

1. Field of the Invention

The invention is directed to a capacitive ignition system for an internal combustion engine.

2. Description of the Related Art

A capacitive ignition system is known, e.g., from U.S. Pat. No. 5,245,965A.

It is currently common in capacitive ignition systems, starting from a minimum required ignition energy with new spark plugs (as ignition device), to provide an effective ignition energy which increases over an aging process of the spark plugs by raising the primary voltage.

By raising the primary voltage such that only the available energy is increased, the voltage that can be tapped by the spark plug at the secondary terminals of the voltage converter rises more steeply prior to breakdown and arcing. This effect escalates spark plug damage and, as a result, shortens the life of the spark plug.

It is an object of the present invention to provide a capacitive ignition system which allows the life of the ignition device to be prolonged.

SUMMARY OF THE INVENTION

It was recognized by the present inventors that the discharge time constant of the primary circuit changes as a result of the conventional adjustment of ignition energy by means of voltage as the ignition energy requirement increases. More precisely, the characteristic specific discharge time in commercially available capacitive ignition systems decreases as the ignition energy requirement increases.

According to the invention, a capacitive ignition system for an internal combustion engine, particularly for a gasoline-powered large engine, including a voltage converter having a plurality of primary terminals and a plurality of secondary terminals, which voltage converter is able to convert a voltage applied to the primary terminals into a higher voltage that can be tapped at the secondary terminals by an ignition device of the internal combustion engine; a primary voltage source for supplying a primary voltage, which primary voltage source has a plurality of voltage source terminals which are connected in each instance to one of the primary terminals of the voltage converter so that a primary circuit is formed; a switch which is incorporated within the primary circuit and which has a controller so that the switch can be closed and opened; a first control device which is connected to the controller of the switch and which is adapted to actuate the controller of the switch in accordance with an ignition pattern for closing and opening, which ignition pattern is predefined for the internal combustion engine; and an electrical capacitance which is incorporated within the primary circuit so that it is chargeable with the primary voltage to a predetermined electric charge when the switch is open and can deliver the charge to the primary terminals of the voltage converter over a specific discharge time when the switch is closed so that the voltage at the secondary terminals of the voltage converter increases to an ignition voltage. The ignition system according to the invention is characterized by a second control device which is configured such that a voltage rise at the secondary terminals occurring in order to reach the ignition voltage is maintained constant as the ignition energy requirement of the ignition device changes.

In other words, according to the invention, one or more system parameters are varied by the second control device as the ignition energy requirement increases so as to maintain constant the secondary-side voltage rise prior to breakdown even in case of increasing ignition energy requirement.

This causes the life of the ignition device (which is preferably configured as a spark plug) to be prolonged, particularly when using high ignition energy. Consequently, wear of the ignition device is reduced through the reduction in breakdown voltage by making selective use of the surge characteristic.

The primary voltage source can have, for example, an electric battery whose DC is increased to a primary voltage of up to approximately 400 volts by a step-up converter. Alternatively, the primary voltage source can have, e.g., an alternator of the internal combustion engine whose AC is increased by a coil transformer to a primary voltage of preferably about 300 volts to 400 volts and is converted to DC by a rectifier.

The switch can be formed, e.g., by a mechanical switch and can have a mechanical controller. Alternatively, the switch can be formed, e.g., by an electronic switch and can have an electronic controller. The switch is preferably formed by a thyristor, and the controller is formed by a gate of the thyristor.

The first control device can have, e.g., a control portion, e.g., a cam portion, provided at a crankshaft of the internal combustion engine. The first control device can have a sensor which cooperates with the control portion for generating an ignition signal. The first control device can further have an electronic pulse generator which generates a control pulse for the gate of the thyristor based on the ignition signal so that the thyristor allows a passage of current.

According to an embodiment of the invention, the second control device is constructed to maintain constant the voltage rise by controlling the specific discharge time as a function of the ignition energy requirement of the ignition device.

According to a further embodiment of the invention, the second control device is constructed to maintain constant the voltage rise by controlling the specific discharge time so that the latter remains constant as the ignition energy requirement of the ignition device changes. In other words, a constant characteristic discharge time of the ignition system is achieved.

According to yet another embodiment of the invention, the primary circuit defines an electrical resistance and an electrical inductance, and the electrical capacitance and/or the electrical resistance and/or the electrical inductance are/is configured so as to be adjustable in value, and the second control device is constructed to control the specific discharge time for maintaining constant the voltage rise by changing the value of the electrical capacitance and/or of the electrical resistance and/or of the electrical inductance.

According to yet another embodiment of the invention, the second control device is constructed to increase the electrical capacitance as the ignition energy requirement of the ignition device increases so as to counteract a shortening of the specific discharge time caused by the increase in the ignition energy requirement.

According to an embodiment of the invention, the second control device is constructed to increase the electrical resistance as the ignition energy requirement of the ignition device increases so as to counteract a shortening of the specific discharge time caused by the increase in the ignition energy requirement.

According to another embodiment of the invention, the second control device is constructed to increase the electrical inductance as the ignition energy requirement of the ignition device increases so as to counteract a shortening of the discharge time caused by the increase in the ignition energy requirement.

According to another embodiment of the invention, the voltage converter is formed by a transformer with a primary coil and a secondary coil, and the electrical inductance is formed by the transformer.

According to yet another embodiment of the invention, the second control device is constructed to change a level of the primary voltage as a function of the ignition energy requirement of the ignition device while simultaneously controlling the specific discharge time.

According to another embodiment of the invention, the second control device is constructed to increase the primary voltage as the ignition energy requirement of the ignition device increases.

Finally, the invention realizes a selective influencing of the discharge time constant on the primary side as a function of the ignition energy requirement, e.g., by changing the primary capacitance in a controlled manner. The inductance or the resistance are also parameters which can be changed to achieve a similar effect. According to the invention, the secondary-side voltage rise is maintained constant before breakdown as the ignition energy requirement increases.

To maintain constant the discharge time constant of the primary circuit, one or more additional system parameters may be varied in addition to the charging voltage (primary voltage) as the ignition energy requirement increases. According to an embodiment of the invention, the electrical capacitance, particularly the capacitance of a primary capacitor, is increased analogous to the primary voltage. When correctly configured, the result is a constant characteristic discharge time of the ignition system.

The invention expressly also extends to embodiments which are not given by combinations of features from explicit references to the claims so that the disclosed features of the invention can be combined in any manner insofar as technically meaningful.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described in more detail with reference to a preferred embodiment and with reference to the accompanying drawings, in which.

DETAILED DESCRIPTION OF THE PRESENTLY PREFERRED EMBODIMENTS

Figure 1:
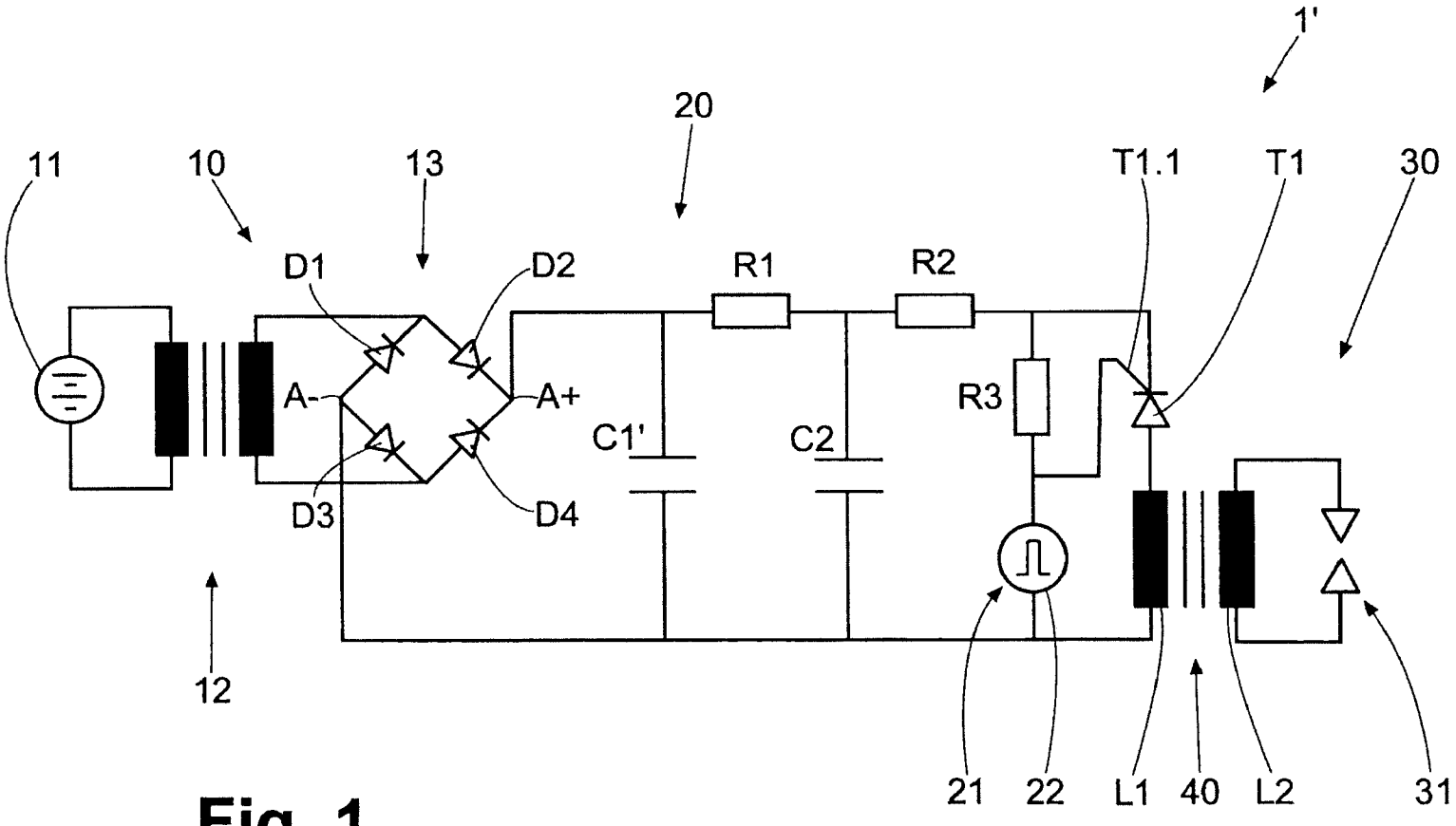
Fig. 1 PRIOR ART
FIG. 1 shows a schematic diagram of a prior art capacitive ignition system for an internal combustion engine.

FIG. 1 shows a schematic diagram of a prior art capacitive ignition system 1' of an internal combustion engine (not shown in its entirety).

The ignition system 1' has a primary voltage source 10, a primary circuit 20, a secondary circuit 30 and a voltage converter 40 which is connected between the primary circuit 20 and the secondary circuit 30.

The primary voltage source 10 has an electric battery 11 providing DC current, a step-up converter 12 and a rectifier 13. The rectifier 13 has four diodes D1-D4 which are connected to one another to form a full-wave bridge rectifier 13. The step-up converter 12 is constructed in such a way that it increases the voltage supplied by the battery 11 to a primary voltage of approximately 300 to 400 volts. Two voltage source terminals A+, A− of the primary voltage source 10 are formed at the rectifier 13.

The primary circuit 20 has an electrical capacitance in the form of two capacitors C1' and C2 (a first capacitor C1' and a second capacitor C2) which are connected in parallel with one another, an electrical resistance in the form of three resistance components R1, R2 and R3 (a first resistance component R1, a second resistance component R2 and a third resistance component R3) which are connected in series with one another, an electronic switch in the form of a thyristor T1, and a control device 21.

The control device 21 has a control portion (not shown) provided at the crankshaft of the internal combustion engine, a Hall sensor or inductive sensor (not shown) which cooperates with the control portion to generate an ignition signal, and an electronic pulse generator 22.

The voltage converter 40 has a transformer with a primary coil L1 and a secondary coil L2. The primary coil L1 has two primary terminals (not designated), and the secondary coil L2 has two secondary terminals (not designated). An ignition device 31 in the form of a spark plug is connected to the secondary terminals of the secondary coil L2 so as to form the secondary circuit 30.

The voltage converter 40 is constructed to convert a voltage applied to its primary terminals into a higher voltage that can be tapped by the ignition device 31 at the secondary terminals.

The anode of the thyristor T1 is connected to one of the primary terminals of the primary coil L1 of the voltage converter 40, while the cathode of the thyristor T1 is connected to one of the terminals of the second resistance component R2. The first and second resistance components R1 and R2 are connected in series with one another; the first resistance component R1 is connected by its terminals remote of the second resistance component R2 to the positive pole (A+) of the two voltage source terminals A+, A− of the primary voltage source 10. The other primary terminal of the primary coil L1 of the voltage converter 40 is connected directly to the negative pole (A−) of the two voltage source terminals A+, A− of the primary voltage source 10.

The third resistance component R3 is connected by one of its terminals to the anode of the thyristor T1 and to the terminal of the second resistance component R2, which terminal is remote of the first resistance component R1, and by its other terminal to one of two terminals of the pulse generator 21 and to a gate T1.1 as a controller of the thyristor T1. The gate T1.1 serves to close and open a cathode-anode path of the thyristor T1 in a controlled manner.

The other terminal of the pulse generator 21 is connected to the negative pole (A−) of the two voltage source terminals A+, A− of the primary voltage source 10 and to the primary terminal, connected thereto, of the primary coil L1 of the voltage converter 40.

In this way, the primary voltage source 10 is connected by both its voltage source terminals A+, A− to one of the two primary terminals of the voltage converter 40, respectively, so as to form the primary circuit 20.

The pulse generator 22 is configured in such a way that it generates a control pulse for the gate T1.1 of the thyristor T1 based on the ignition signal so that the thyristor T1 allows a passage of current across its cathode-anode path.

The control device 21 is accordingly connected to the gate T1.1 of the thyristor T1 and is constructed to actuate the gate T1.1 of the thyristor T1 according to an ignition pattern predefined for the internal combustion engine for closing and opening the cathode-anode path.

As was described above, the electrical capacitance in the form of the two capacitors C1', C2 is incorporated in the primary circuit 20 so that it can be charged with the primary voltage to a predetermined electric charge when the switch is open, i.e., when the cathode-anode path of the thyristor T1 is open or nonconducting, and can deliver the charge to the primary terminals of the voltage converter 40 over a specific discharge time when the switch is closed, i.e., when the cathode-anode path of the thyristor T1 is closed or conducting, so that the voltage at the secondary terminals of the voltage converter 40 increases to an ignition voltage which leads to breakdown or arcing at the ignition device 31.

During operation of the ignition system 1', the two capacitors C1', C2 are charged continuously (also discontinuously when step-up controller 12 is adjustable) by the primary voltage source 10 to approximately 300 to 400 volts. When the thyristor T1 receives a positive control pulse for the gate T1.1 from the pulse generator 22 at the ignition point based on the ignition signal, it conducts (the cathode-anode path is closed) and the two capacitors C1', C2 discharge across the primary coil L1 of the voltage converter 40. The discharge current surge induces the ignition voltage in the secondary coil L2, which ignition voltage can amount to about 15 to 55 kilovolts, for example, and leads to breakdown or arcing at the ignition device 31.

Figure 2:
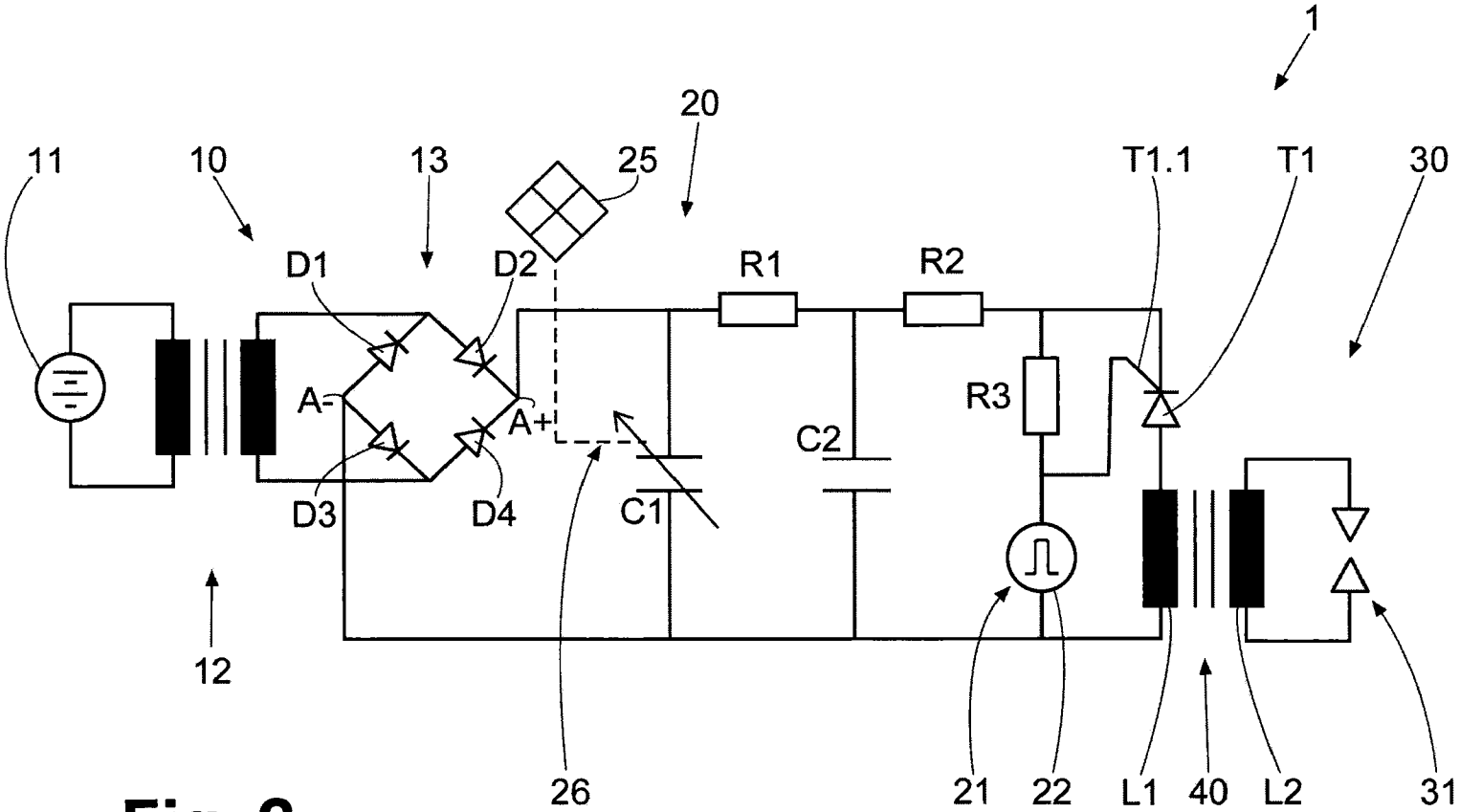
FIG. 2 shows a schematic diagram of a capacitive ignition system configured according to an embodiment of the present invention for an internal combustion engine.

Referring now to FIG. 2, a capacitive ignition system 1 of an internal combustion engine (not shown in its entirety) will be described according to an embodiment of the present invention. FIG. 2 shows a schematic diagram of the capacitive ignition system 1 according to the invention.

Apart from certain differences in construction and function, the ignition system 1 shown in FIG. 2 is identical to the ignition system 1' shown in FIG. 1. Therefore, only these differences will be enumerated, and identical or similar components are provided with identical or similar reference numerals.

In contrast to FIG. 1, the first capacitor C1 in the ignition system 1 according to the invention in FIG. 2 is constructed so as to be adjustable with respect to the value of its electrical capacitance. To this end, the first capacitor C1 can be constructed, e.g., as a continuously adjustable rotary variable capacitor or, e.g., in the form of a plurality of capacitors which can be connected in parallel with each other in stages.

In the ignition system 1 according to the invention shown in FIG. 2, a second control device 25 is provided in addition to the first control device 21. The second control device 25 has an actuator 26 (e.g., a servo motor or a switch) which is constructed to adjust the value of the electrical capacitance of the first capacitor C1 as a function of an ignition energy requirement of the ignition device 31.

The actual ignition energy requirement can be determined by the second control device 25, e.g., by means of a measuring device (not shown) which is integrated in the secondary circuit 30 and signal-connected to the second control device 25.

The second control device 25 is preferably constructed to increase the electrical capacitance of the first capacitor C1 as the ignition energy requirement of the ignition device 31 increases so as to counteract a shortening of the specific discharge time caused by the increase in the ignition energy requirement.

Accordingly, a voltage rise which occurs at the secondary terminals of the secondary coil L2 for reaching the ignition voltage is maintained constant by the second control device 25 also as the ignition energy requirement of the ignition device 31 changes in that the discharge time is controlled and particularly maintained constant as a function of the ignition energy requirement of the ignition device 31.

Alternatively or in addition to the change in value of the electrical capacitance C1, C2 of the primary circuit 20, at least one of the electric resistance components R1, R2, R3 and/or the electrical inductance of the voltage converter 40 can also be adjusted with respect to value (although this is not depicted as such in FIG. 2).

In this case, the second control device 25 can be constructed to control the discharge time for maintaining constant the voltage rise by changing the value of the electrical capacitance C1, C2, electrical resistance R1, R2, R3 and/or the electrical inductance of the voltage converter 40.

The second control device 25 can preferably increase the value of the electrical resistance of the resistance components R1, R2, R3 as the ignition energy requirement of the ignition device 31 increases so as to counteract a shortening of the specific discharge time caused by the increase in the ignition energy requirement. The second control device 25 can increase the value of the electrical inductance of the voltage converter 40 as the ignition energy requirement of the ignition device 31 increases so as to counteract a shortening of the specific discharge time caused by the increase in the ignition energy requirement.

In addition to the change in the system parameters of electrical capacitance, electrical resistance and/or electrical inductance described above, the second control device 25 can be constructed to change a level of the primary voltage as a function of the ignition energy requirement of the ignition device 31, particularly to increase the primary voltage as the ignition energy requirement of the ignition device 31 increases, while simultaneously controlling the discharge time (i.e., changing the system parameters of electrical capacitance, electrical resistance and/or electrical inductance).

Finally, the invention realizes a selective influencing of the discharge time constant on the primary circuit side 20 as a function of the ignition energy requirement, e.g., by changing the primary capacitance in a controlled manner. According to the invention, the inductance or the resistance can also be parameters which can be changed to achieve a similar effect. According to the invention, the secondary-side voltage rise is therefore maintained constant before breakdown as the ignition energy requirement increases. Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A capacitive ignition system for an internal combustion engine comprising:

a voltage converter (40) having a plurality of primary terminals and a plurality of secondary terminals, said voltage converter (40) configured to convert a voltage applied to said primary terminals into a higher voltage that can be tapped at said secondary terminals by an ignition device (31) of the internal combustion engine;

a primary voltage source (10) configured to supply a primary voltage, said primary voltage source (10) having a plurality of voltage source terminals (A+, A−) connected in each instance to one of said primary terminals of said voltage converter (40) so that a primary circuit (20) is formed;

a switch (T1) incorporated within the primary circuit (20), said switch having a controller (T1.1) configured to open and close said switch (T1);

a first control device (21) connected to said controller (T1.1) of said switch (T1), said control device configured to actuate said controller (T1.1) of said switch (T1) in accordance with a predefined ignition pattern for closing and opening;

an electrical capacitance (C1, C2) incorporated within the primary circuit (20) so as to be chargeable with the primary voltage to a predetermined electric charge when said switch (T1) is open and configured to deliver the charge to said primary terminals of said voltage converter (40) over a specific discharge time when said switch (T1) is closed so that the voltage at said secondary terminals of said voltage converter (40) increases to an ignition voltage; and a second control device (25) configured such that a voltage rise at said secondary terminals occurring in order to reach the ignition voltage is maintained constant as the ignition energy requirement of the ignition device (31) changes, wherein said second control device (25) is configured to maintain constant the voltage rise by controlling the specific discharge time as a function of the ignition energy requirement of the ignition device (31), wherein said primary circuit (20) comprises an electrical resistance (R1, R2, R3) and an electrical inductance, wherein each of said electrical capacitance (C1, C2), said electrical resistance (R1-R3) and said electrical inductance is constructed so as to be adjustable in value, wherein said second control device (25) is configured to control the specific discharge time for maintaining constant the voltage rise by said second control device (25) selectively controlling the adjustable value of each one of the adjustable electrical capacitance (C1, C2), the adjustable electrical resistance (R1-R3) and the adjustable electrical inductance, so as to maintain constant the voltage rise at said secondary terminals occurring in order to reach the ignition voltage so as to prevent a breakdown or arcing at the ignition device (31) as the ignition energy requirement of the ignition device (31) changes, wherein said second control device (25) is configured to maintain constant the voltage rise by controlling the specific discharge time so as to remain constant as the ignition energy requirement of the ignition device (31) changes, and wherein said second control device (25) is further configured to:

increase the adjustable electrical capacitance (C1, C2) as the ignition energy requirement of the ignition device (31) increases so as to counteract a shortening of the specific discharge time caused by the increase in the ignition energy requirement, increase the adjustable electrical resistance (R1-R3) as the ignition energy requirement of the ignition device (31) increases so as to counteract a shortening of the discharge time caused by the increase in the ignition energy requirement, and increase the adjustable electrical inductance as the ignition energy requirement of the ignition device (31) increases so as to counteract a shortening of the discharge time caused by the increase in the ignition energy requirement.

2. The capacitive ignition system according to claim 1, wherein said voltage converter (40) comprises a transformer having a primary coil (L1) and a secondary coil L2), and wherein the electrical inductance is formed by the transformer.

3. The capacitive ignition system according to claim 1, wherein said second control device (25) is configured to change a level of the primary voltage as a function of the ignition energy requirement of the ignition device (31) while simultaneously controlling the discharge time.

4. The capacitive ignition system according to claim 3, wherein said second control device (25) is configured to increase the primary voltage as the ignition energy requirement of the ignition device (31) increases.

* * * * *